US006109333A

United States Patent [19]

Pontzer

[11] Patent Number: 6,109,333

[45] Date of Patent: Aug. 29, 2000

[54] METHOD OF MANUFACTURING ELECTRIC MOTOR HOUSING FRAME AND FOAM PATTERN THEREFOR

[75] Inventor: Joseph H. Pontzer, Athens, Ga.

[73] Assignee: Reliance Electric Technologies, LLC, Thousand Oaks, Calif.

[21] Appl. No.: 09/115,655

[22] Filed: Jul. 15, 1998

[51] Int. Cl.[7] ..... B22C 9/02; B22C 7/00

[52] U.S. Cl. ..... 164/34; 164/35; 164/36; 164/45

[58] Field of Search ..... 164/34, 35, 36, 164/45, 235, 246, 249

[56] References Cited

U.S. PATENT DOCUMENTS 3,942,583 3/1976 Baur ..... 164/246

*Primary Examiner*—Harold Pyon
*Assistant Examiner*—I.-H. Lin
*Attorney, Agent, or Firm*—Craig N. Killen; John J. Horn; William R. Walbrun

[57] ABSTRACT

Housing frames for use in electromechanical machines may be advantageously produced using a novel pattern form in a lost foam casting process. The pattern form is made from a cast dissolvable material, and is configured to permit easy modification prior to casting. The pattern form may be adapted to produce footed or footless housing frames, or housing frames of various axial lengths. In addition, the frame area on which a conduit box will be attached can be easily modified prior to casting. After the pattern form has been modified, it is placed in a casting medium of dry particulate material, such as sand. Upon contact with molten metal, the pattern form vaporizes. The molten metal fills the space where the pattern form had been, assuming the desired shape. After the molten metal has cooled to rigidity, the resulting housing frame can be removed from the casting medium.

9 Claims, 7 Drawing Sheets

FIG. 6
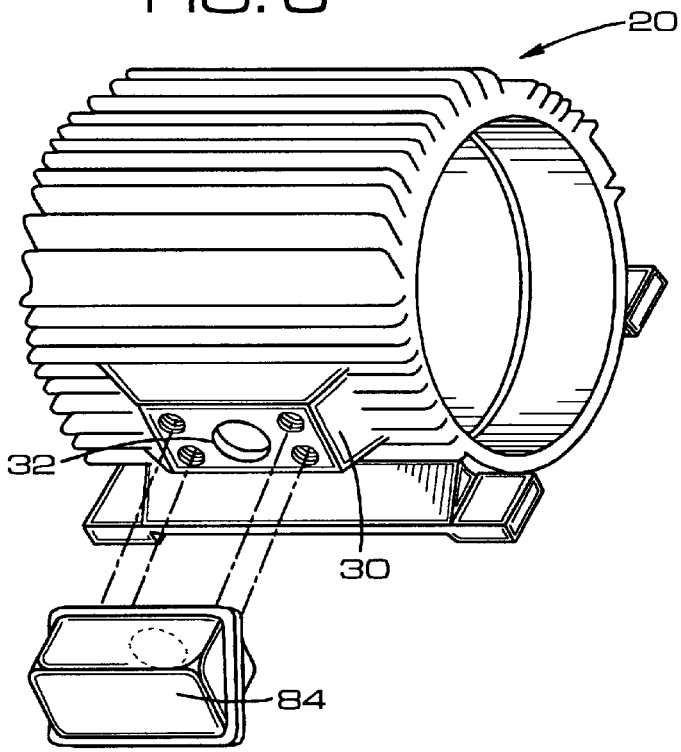
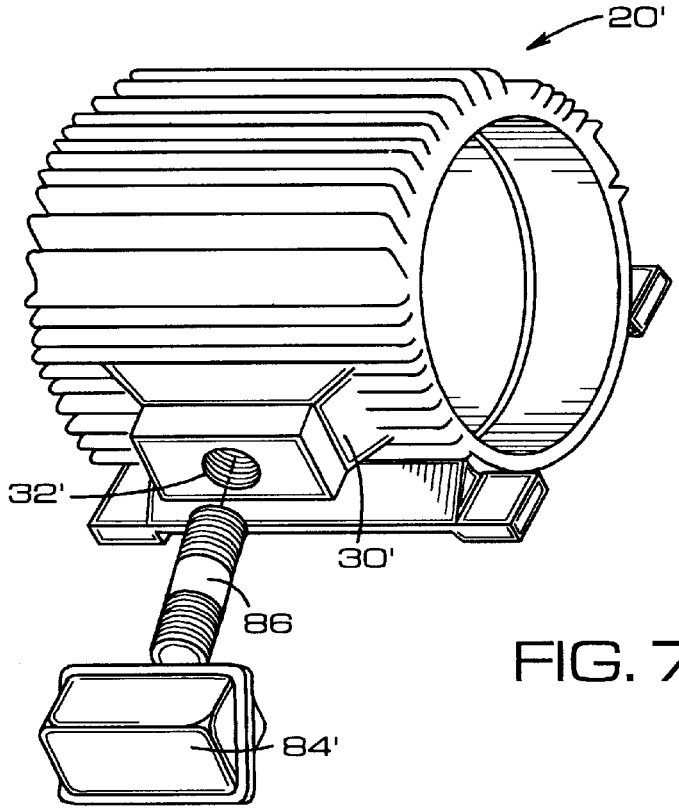
FIG. 7

METHOD OF MANUFACTURING ELECTRIC MOTOR HOUSING FRAME AND FOAM PATTERN THEREFOR

BACKGROUND OF THE INVENTION

The present invention relates generally to the art of electric motors and other electromechanical machines. More particularly, the invention relates to improved methods of manufacturing housing frames for such electromechanical machines.

In the past, housing frames for electric motors and the like have been made by a variety of manufacturing processes. For example, housing frames have often been cast utilizing a reusable pattern form. In this case, the pattern form, which may be made of wood or metal, is placed in oil-impregnated sand or other suitable casting medium. After the sand is suitably packed, the pattern form is removed to leave a void of the desired shape. Next, molten metal is poured into the void, which cools to form the housing frame.

More recently, some manufacturers have begun using a "lost foam" casting technique. In this process, a pattern form of the frame to be cast is placed in a dry sand casting medium. The sand is vibrated to ensure that the pattern form is completely surrounded, without leaving undesirable voids. With the pattern form in place, molten metal is poured into the casting medium. The pattern form, typically made of polystyrene or the like, vaporizes upon contact with the molten metal. As a result, the molten metal fills the void left by the pattern form, and assumes the desired shape. After the molten metal has cooled to rigidity, the housing frame is removed from the casting medium.

The traditional manner in which "lost foam" casting has been performed is not without disadvantages. For example, it believed that others have provided different pattern forms for different frame styles to be produced, even within a single inner diameter size. In this case, it may be necessary to provide many different pattern forms. For example, a single inner diameter size may include footed and footless frames, as well as frames of different axial lengths. It would be advantageous to provide a technique with greater flexibility, in which a single pattern form can be used with multiple frame styles.

SUMMARY OF THE INVENTION

The present invention recognizes and addresses the foregoing disadvantages, and others of prior art constructions and methods. Accordingly, it is an object of the invention to provide improved methodology for the manufacture of housing frames.

It is a more particular object of the present invention to provide improved methodology for the manufacture of housing frames using a lost foam casting process.

It is a further object of the present invention to provide an improved pattern form for use in manufacturing housing frames by a lost foam process.

It is a further object of the present invention to provide a improved housing frame for use in an electromechanical machine.

Some of these objects are achieved by a method of manufacturing a housing frame for use in an electromechanical machine. One step of the method involves providing a pattern form in a configuration of a housing frame, the pattern form defining a first axial length greater than a second axial length of the housing frame. The pattern form is made from a cast dissolvable material, such as polystyrene or other foam material that vaporizes upon contact with molten metal. Next, an axial portion of the pattern form equal to a difference between the first axial length and the second axial length is removed. The pattern form, as modified, is then situated in a particulate casting medium. Molten metal is next inserted into the casting medium to displace the pattern form and fill a space that had been occupied thereby. After the molten metal has cooled to rigidity, the housing frame can be removed from the casting medium.

According to exemplary methodology, the axial portion of the pattern form is removed from an intermediate region thereof. In this case, respective end portions of the pattern form are adhered back together to form the modified pattern form. Often, the axial portion of the pattern form will have an axial length of at least approximately five inches.

Other objects of the present invention are achieved by a method in which a cast dissolvable pattern form initially defines foot structures thereon. The foot structures are then removed to produce a modified pattern form. Next, the modified pattern form is situated in a particulate casting medium. Next, molten metal is inserted into the particulate casting medium to displace the pattern form and fill a space that had been occupied thereby. After the molten metal has cooled to rigidity, the housing frame can be removed from the casting medium.

Still further objects of the present invention are achieved by a method in which the pattern form defines a conduit box attachment area. A pad of the cast dissolvable material from which the pattern form is made can then be adhered to the conduit box attachment area to enhance a thickness thereof in the resulting housing frame. Next, the pattern form is situated in a particulate casting medium. Molten metal is inserted into the particulate casting medium to displace the pattern form and fill a space that had been occupied thereby. After the molten metal has cooled to rigidity, the housing frame can be removed from the casting medium.

Additional objects of the present invention are achieved by a pattern form used in manufacturing a housing frame for an electromechanical machine by a lost foam casting process. The pattern form comprises a form body made of a foam material, such as polystyrene, that vaporizes upon contact with molten metal. The form body comprises a generally cylindrical portion defining a predetermined axial length. In addition, the form body includes a plurality of foot structures attached to the generally cylindrical portion.

In some exemplary embodiments, it will be desirable to provide boss structures on the form body. In addition, a generally planar surface, raised with respect to the generally cylindrical portion and integral therewith, may be provided to produce a conduit box attachment area.

Other objects of the invention are achieved by a housing frame for use in an electromechanical machine. The housing frame comprises a generally cylindrical portion defining a plurality of longitudinal cooling fins thereon. A plurality of foot structures integrally extend from the generally cylindrical portion. Each of the foot structures defines a planar bottom surface for supporting the housing frame in a substantially horizontal orientation. Furthermore, a plurality of boss structures integrally extend from the generally cylindrical portion. At least one of the boss structures defines a planar top surface extending in parallel to the bottom surface of the foot structures.

In some exemplary embodiments, the housing frame defines at least one rail insertion slot extending in parallel to the boss structure's planar top surface. A conduit box attachment area may also be defined, integrally attached to the generally cylindrical portion. The conduit box attachment area preferably defines a generally planar attachment surface.

Other objects, features and aspects of the present invention are achieved by various combinations and subcombinations of the disclosed elements, which are discussed in greater detail below.

BRIEF DESCRIPTION OF THE DRAWINGS

A full and enabling disclosure of the present invention, including the best mode thereof, to one of ordinary skill in the art, is set forth more particularly in the remainder of the specification, including reference to the accompanying drawings, in which:

FIG. 6 is a perspective view of a housing frame of the present invention showing attachment of a conduit box according to a first embodiment; and FIG. 7 is a perspective view of a housing frame of the present invention showing attachment of a conduit box according to a second embodiment.

Figure 1:
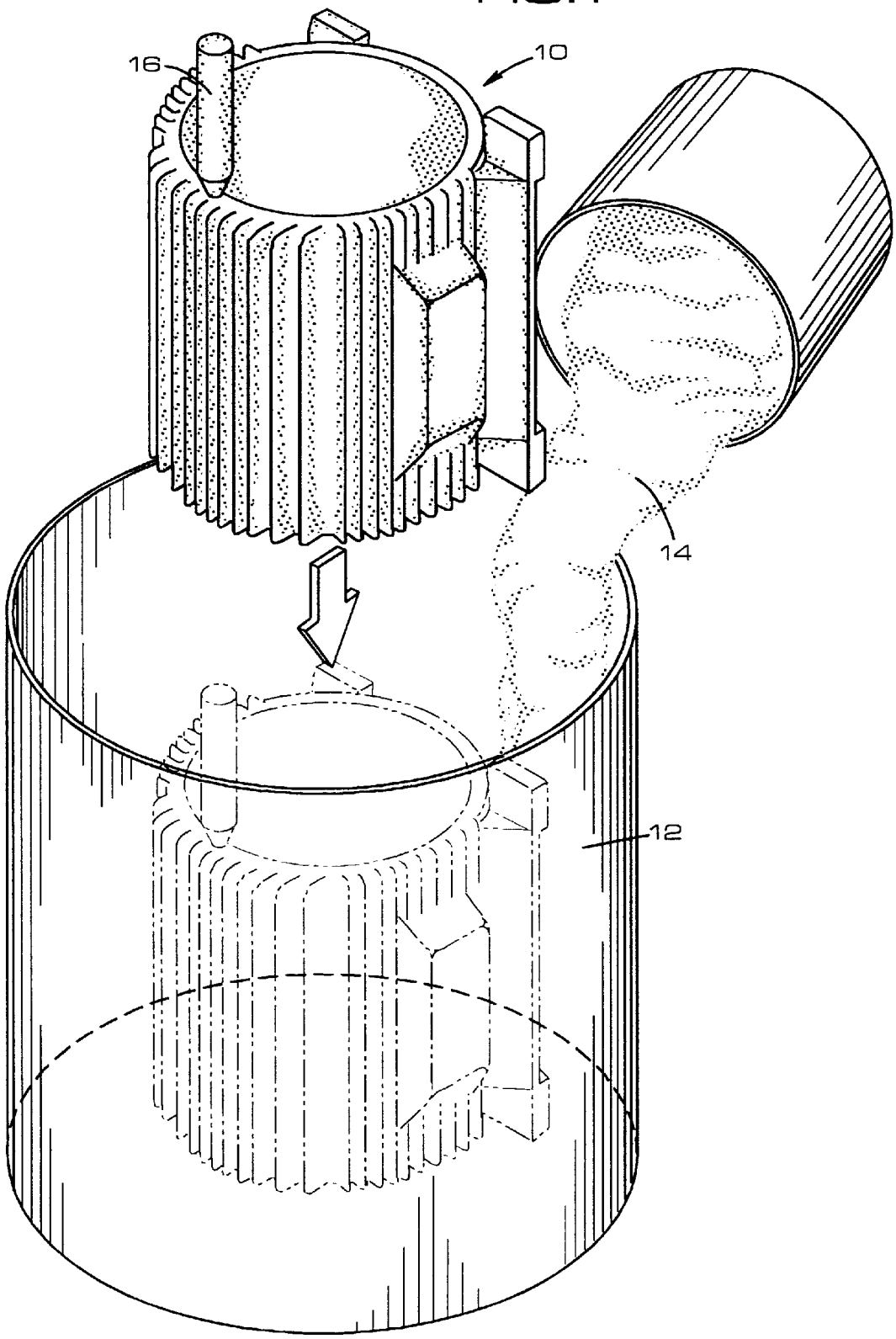
FIG. 1 is a diagrammatic representation showing placement of a foam pattern form of the present invention into a dry sand casting medium.

Repeat use of reference characters in the present specification and drawings is intended to represent same or analogous features or elements of the invention.

DETAILED DESCRIPTION OF PREFERRED EMBODIMENTS

It is to be understood by one of ordinary skill in the art that the present discussion is a description of exemplary embodiments only, and is not intended as limiting the broader aspects of the present invention, which broader aspects are embodied in the exemplary constructions.

As described above, the present invention provides improvements in the manufacture of housing frames for electric motors or other electromechanical machines. The motor frames are made by a lost foam casting process utilizing a novel pattern form. Due to its configuration, a single pattern form permits the casting of multiple frame styles within a single inner diameter size.

General aspects of the lost foam casting process may be easily explained with reference to FIGS. 1 and 2. First, a pattern form 10 of the present invention is positioned in a suitable container 12. Pattern form 10 is preferably made from a foam material, such as polystyrene, that vaporizes upon contact with molten metal. A dry particulate casting medium, such as sand 14, is then placed in container 12 to surround and cover pattern form 10.

As can be seen, pattern form 10 includes a sprew 16 which extends to at least the surface of sand 14 when pattern form 10 is embedded. After sand 14 has been agitated to fill undesired voids, molten metal 18 is added utilizing sprew 16. The foam material of pattern form 10 vaporizes upon contact with molten metal 18. The vapor diffuses through sand 14, allowing molten metal 18 to fill the space where pattern form 10 had been. The resulting housing frame may be removed from sand 14 when molten metal 18 has cooled to rigidity.

Figure 2:
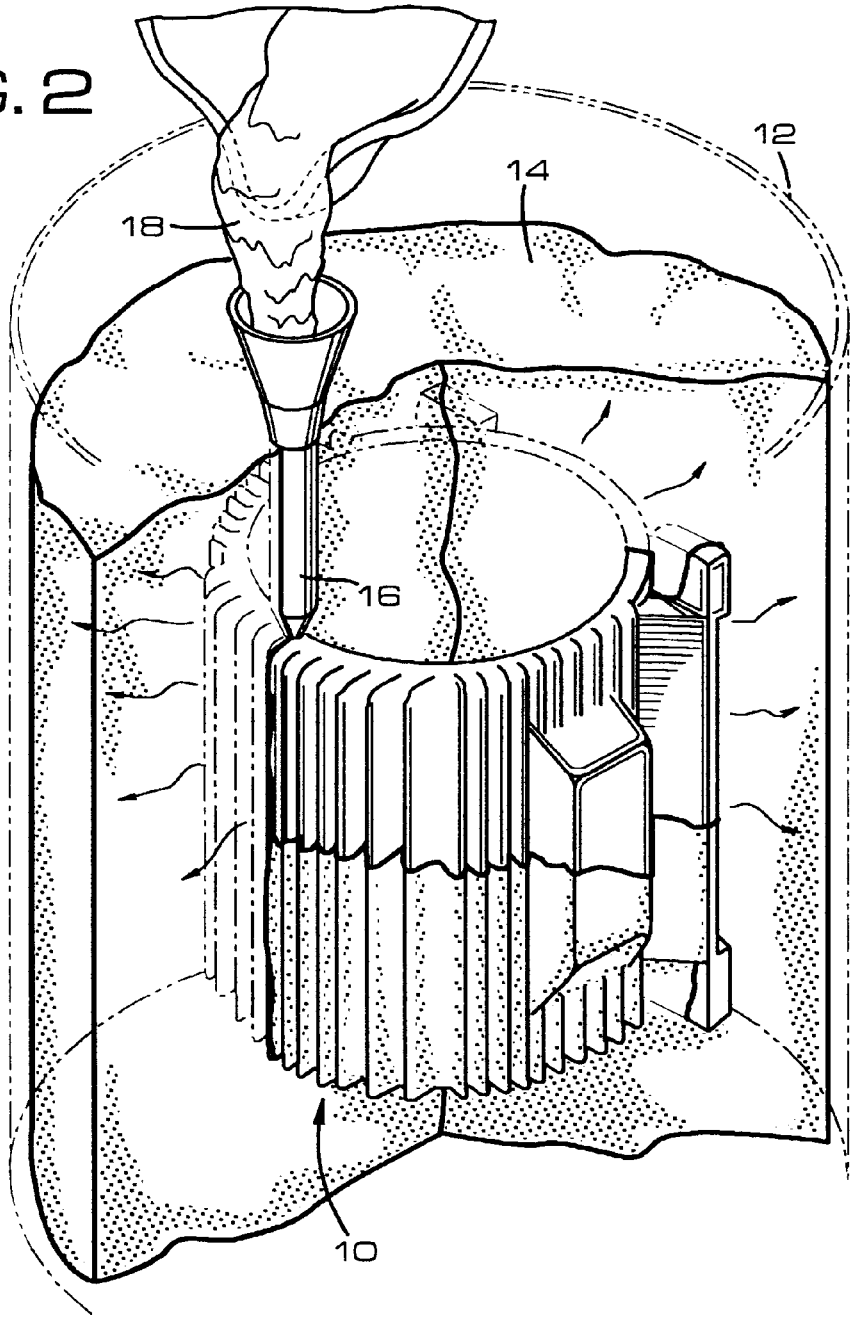
FIG. 2 shows molten metal being inserted into the casting medium of FIG. 1 with the pattern form in place.
Figure 3:
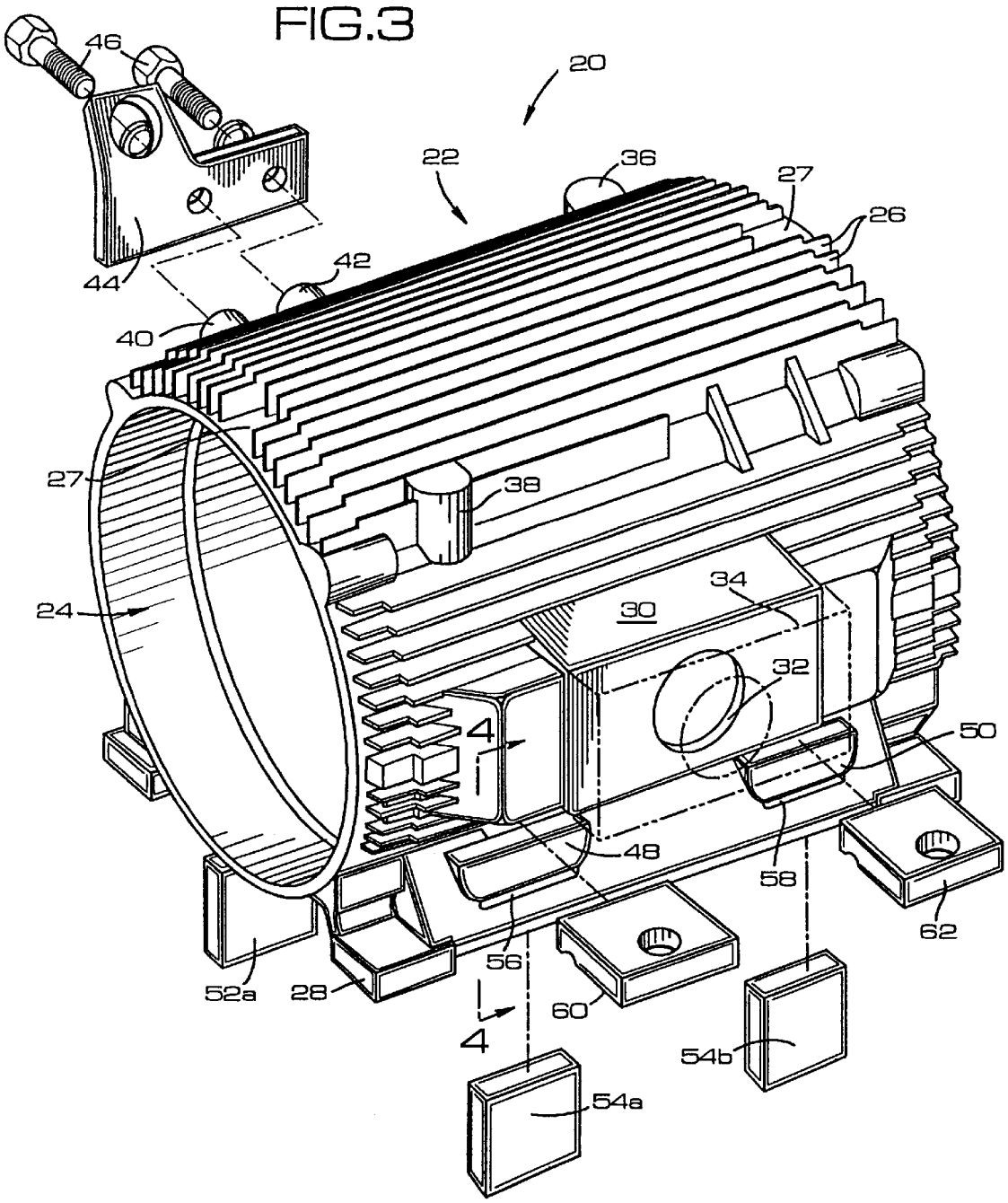
FIG. 3 is a perspective view of a housing frame of the present invention showing various advantageous features thereof.

FIG. 3 illustrates a housing frame 20 that may be produced by the lost foam process shown in FIGS. 1 and 2. It will be appreciated that the configuration of housing frame 20 will be a replica of pattern form 10. Like pattern form 10, housing frame 20 thus includes a generally cylindrical portion 22 defining an internal cavity 24. As one skilled in the art will recognize, the stator and other internal components of the electromechanical machine are supported within this internal cavity.

As shown, housing frame 20 preferably includes various features integrally formed thereon. For example, a plurality of parallel cooling fins 26 may be defined on the exterior of cylindrical portion 22. The exterior of cylindrical portion 22 may also define or more unfinned areas, such as areas 27. Depending on the exigencies of a particular application, holes may be tapped through these unfinned areas to allow passage of sensor leads and the like. Housing frame 20 may further include a plurality of foot structures, such as foot structure 28.

Motor frame 20 further includes a raised area 30 onto which a conduit box may be attached. Area 30 includes a generally planar surface defining a hole 32 through which power leads and other wires from the electromechanical machine can extend. As indicated in phantom at 34, it may be desirable in some applications to enhance the thickness of the wall of area 30.

Housing frame 20 also includes bosses, which are provided at various locations for the attachment of lifting hardware. For example, bosses 36 and 38 may be tapped to receive eye-bolts used in moving the electromechanical machine from place to place. Housing frame 20 may also include a pair of adjacent bosses 40 and 42, which permit the attachment of a lifting lug 44 (such as by bolts 46).

As a particular advantage, housing frame 20 can be utilized in both horizontal and vertical applications. When used in a horizontal orientation, housing frame 20 will be supported by the foot structures. On the other hand, lifting lugs, such as lifting lug 44, are typically utilized to hang the electromechanical machine when used in a vertical orientation. Accordingly, bosses 40 and 42 extend in a direction perpendicular to bosses 36 and 38.

A first pair of lug pads 48 and 50 are located near the foot structures of housing frame 20, as shown. A similar but oppositely facing pair of lug pads are located on the other side of housing frame 20. Lug pads 48 and 50 may be tapped for the attachment of additional lifting lugs. For example, it will be appreciated that lifting lug 44 provides only one point from which to hang the electromechanical machine. Thus, in order for the machine to hang correctly, it will generally be necessary to provide an additional lifting lug at lug pad 48 (a symmetrical location).

Figure 4:
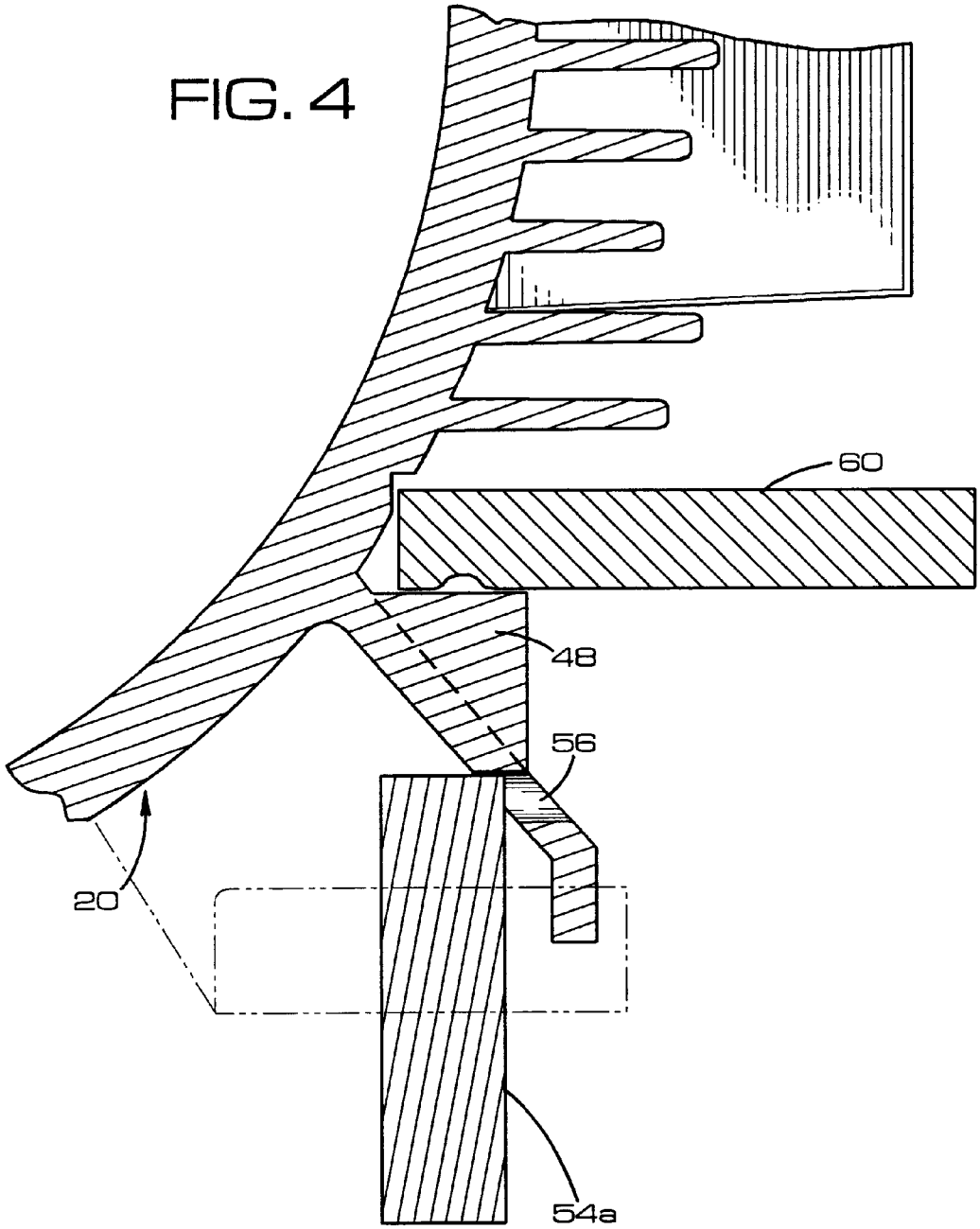
FIG. 4 is a cross-sectional view taken along line 4—4 of FIG. 3 showing a positioning mechanism which may be used during machining of the cast frame.

As can be seen, lug pads 48 and 50 (as well as the similar lug pads located on the other side) each define a substantially planar top surface extending in parallel to the bottom surface of the foot structures. Referring now also to FIG. 4, this configuration provides a means of maintaining motor frame 20 securely in position for subsequent manufacturing procedures, such as machining.

For example, motor frame 20 may be placed on parallel rail pairs 52*a–b* and 54*a–b*. A portion of each rail is received in slots, such as slots 56 and 58, defined in housing frame 20. When housing frame 20 is so positioned, retaining elements, such as retaining elements 60 and 62, can be placed over the planar top surface of the lug pads to prevent undesirable movement of housing frame 20 during machining and the like.

Figure 5A:
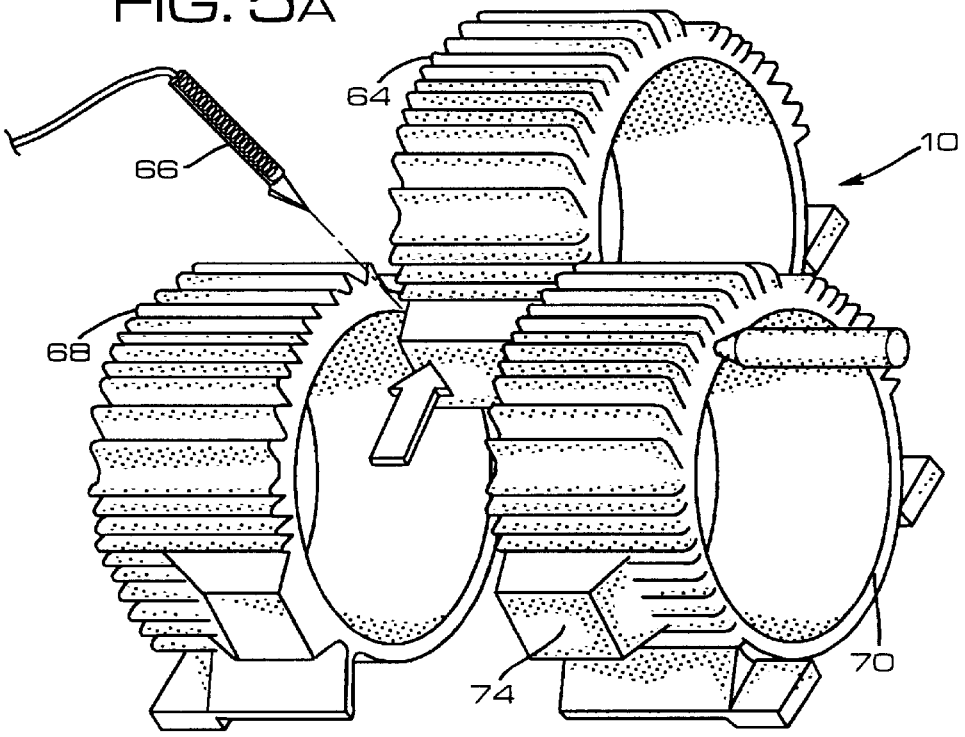
FIG. 5A is a diagrammatic representation showing removal of an axial portion of the pattern form.
Figure 5B:
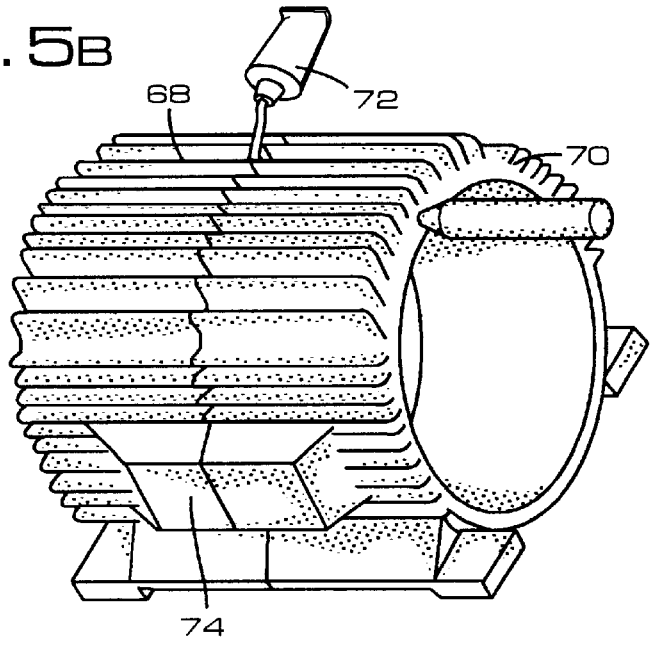
FIG. 5B is a diagrammatic representation of two end portions of the pattern form of FIG. 5A being adhered back together.

As noted above, the configuration of pattern form 10 advantageously allows multiple frame styles to be cast within a single inner diameter size. For example, FIG. 5A illustrates the manner in which pattern form 10 may be modified to produce a housing frame of lesser axial length. Toward this end, an axial portion 64 of a selected axial length is removed from the center of pattern form 10, using a hot knife 66 or other suitable means. Often, the removed axial length may be approximately five inches or more. After axial portion 64 is removed, the respective end portions 68 and 70 are brought together and bonded utilizing a suitable adhesive, such as that indicated at 72. Pattern form 10, as so modified, is then used to cast a housing frame as described above.

In order to facilitate length adjustment, pattern form 10 is configured such that the end portions will align and match over the range of axial lengths that will be removed. It can also be seen that pads of the respective foot structures will advantageously remain in the corners of pattern form 10 as the length is adjusted in this manner.

In addition, conduit box attachment area 74 is sufficiently sized in the unmodified pattern form to account for shortening of the axial length of pattern form 10. In other words, enough of attachment area 74 must remain after the length of pattern form 10 is reduced to permit attachment of a conduit box. Often, the axial length of attachment area 74 in the unmodified pattern form will be at least approximately twelve inches. Preferably, the lead hole is cut in attachment area 74 prior to casting.

Figure 5C:
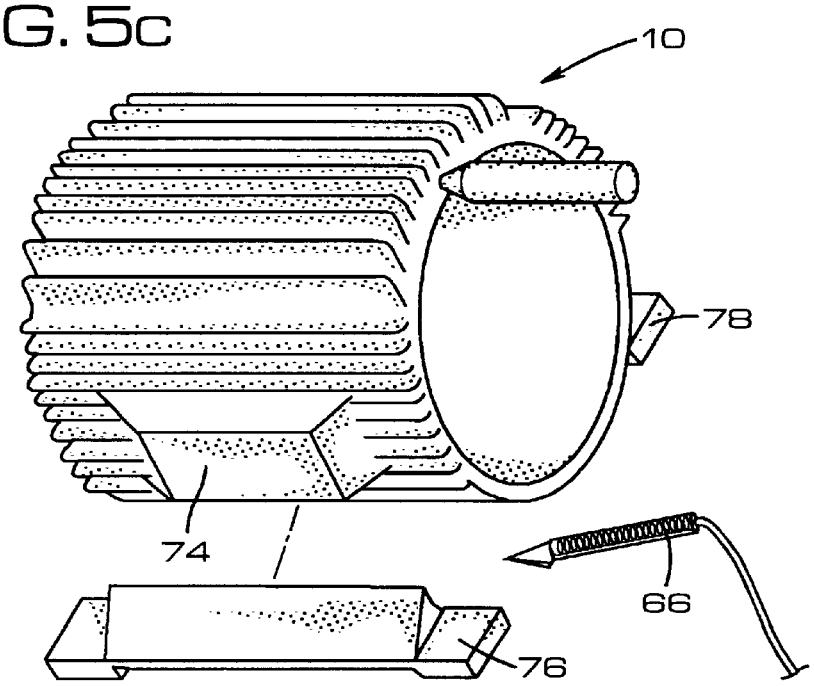
FIG. 5C is a diagrammatic representation showing removal of foot structures from the modified pattern form of FIG. 5B.

If the motor to be made using the resulting housing frame will be employed in a vertical orientation, horizontal foot structures will be unnecessary. Unless modified, however, pattern form 10 will yield a footed housing frame when it is cast. Toward this end, integral foot structures 76 and 78 may be easily removed from pattern form 10 as shown in FIG. 5C. This is contrast to other lost foam casting procedures where a footless frame is normally cast, but feet are added where desired.

Figure 5D:
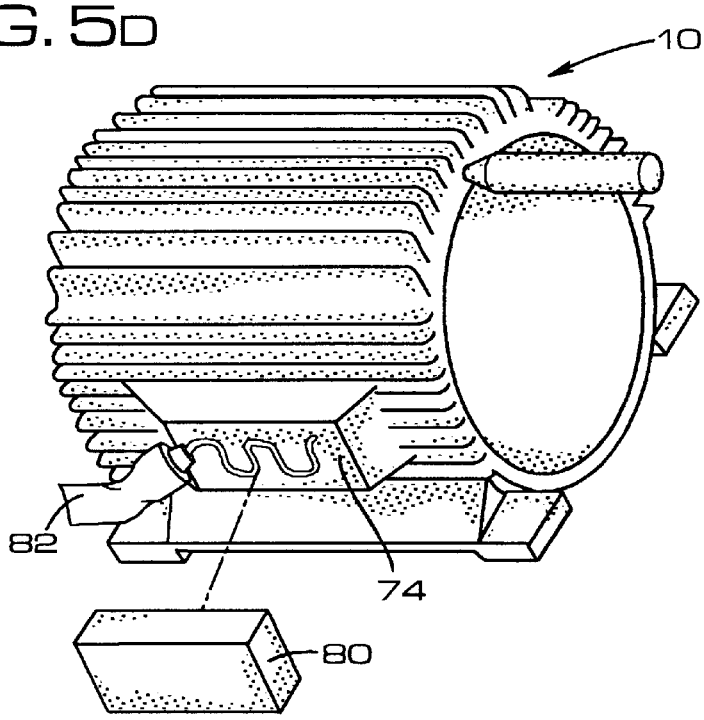
FIG. 5D is a diagrammatic representation showing the addition of a pad to the conduit box attachment area of the modified pattern form of FIG. 5B to enhance a thickness thereof in the resulting housing frame.

FIG. 5D illustrates a further modification of pattern form 10 to achieve enhanced thickness of the conduit box attachment area. Where such enhanced thickness is required, a pad 80 of the desired extra thickness may be added to the conduit box attachment area 74. Pad 80, which is made of the same foam material as pattern form 10, is typically bonded using a suitable adhesive, as indicated at 82.

FIGS. 6 and 7 illustrate alternative manners by which conduit boxes may be attached to housing frame 20. In FIG. 6, conduit box attachment area 30 has been made without enhanced thickness. In this case, conduit box 84 is bolted directly to the planar surface of attachment area 30. Power leads and the like are brought into conduit box 30 through untapped hole 32.

A housing frame 20' having a conduit box attachment area 30' of enhanced thickness is illustrated in FIG. 7. The enhanced thickness permits lead hole 32' to be tapped with threads, as shown. To mount conduit box 84', one end of a pipe fitting 86 is threaded into hole 32'. The other end of pipe fitting 86 is received in a similar threaded hole defined in the back of conduit box 84'. Pipe fitting 84' will often be packed with a sealant material surrounding the exiting power leads. It will be appreciated that this arrangement may be particularly useful in motors required to meet "explosion proof" specifications.

It can thus be seen that the present invention provides various improvements in the manufacture of housing frames for use in electromechanical machines. While preferred embodiments of the invention have been shown and described, modifications and variations may be made thereto by those of ordinary skill in the art without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to be limitative of the invention so further described in such appended claims.

What is claimed is:

1. A method of manufacturing a housing frame for use in an electromechanical machine, said method comprising steps of:

(a) providing a pattern form in a configuration of a housing frame, said pattern form being made of a cast dissolvable material and defining a first axial length greater than a second axial length of said housing frame, the difference between said first axial length and said second axial length being an axial portion of said pattern form;

(b) removing said axial portion of said pattern form equal to a difference between said first axial length and said second axial length to yield respective end portions and adhering said end portions of said pattern form back together;

(c) situating said pattern form in a particulate casting medium;

(d) inserting molten metal into said particulate casting medium to displace said pattern form and fill a space that had been occupied thereby; and (e) after said molten metal has cooled to rigidity, removing said housing frame from said casting medium.

2. A method as set forth in claim 1, wherein said axial portion is removed in step (b) from an intermediate region of said pattern form to yield said respective end portions thereof.

3. A method as set forth in claim 2, wherein said pattern form initially defines foot structures thereon, and step (b) further comprises removing said foot structures from said pattern form.

4. A method as set forth in claim 1, wherein said pattern form defines a conduit box attachment area, and step (b) further comprises adhering a pad of said foam material to said conduit box attachment area to enhance a thickness thereof in said housing frame.

5. A method as set forth in claim 1, wherein said axial portion of said pattern form has an axial length of at least approximately five inches.

6. A method as set forth in claim 1, wherein said cast dissolvable material comprises a foam material that vaporizes upon contact with said molten metal.

7. A method as set forth in claim 6, wherein said foam material comprises a polystyrene foam material.

8. A method of manufacturing a housing frame for use in an electromechanical machine, said method comprising steps of:

(a) providing a pattern form in a configuration of a housing frame, said pattern form being made of a cast dissolvable material and defining foot structures thereon;

(b) removing said foot structures from said housing frame;

(c) situating said pattern form in a particulate casting medium;

(d) inserting molten metal into said particulate casting medium to displace said pattern form and fill a space that had been occupied thereby; and (e) after said molten metal has cooled to rigidity, removing said housing frame from said casting medium.

9. A method of manufacturing a housing frame for use in an electromechanical machine, said method comprising steps of:

(a) providing a pattern form in a configuration of a housing frame, said pattern form being made of a cast dissolvable material and defining a conduit box attachment area;

(b) adhering a pad of said cast dissolvable material to said conduit box attachment area to enhance a thickness thereof in said housing frame;

(c) situating said pattern form in a particulate casting medium;

(d) inserting molten metal into said particulate casting medium to displace said pattern form and fill a space that had been occupied thereby; and (e) after said molten metal has cooled to rigidity, removing said housing frame from said casting medium.

* * * * *